United States Patent [19]

Walter

[11] 4,397,400

[45] Aug. 9, 1983

[54] NONDETACHABLE RESEALABLE CLOSURE

[75] Inventor: John Walter, Evergreen Park, Ill.

[73] Assignee: The Continental Group, Inc., Stamford, Conn.

[21] Appl. No.: 355,832

[22] Filed: Mar. 8, 1982

[51] Int. Cl.[3] ..... B65D 43/16; B65D 43/18; B65D 51/18

[52] U.S. Cl. ..... 220/259; 220/269; 220/307; 220/257; 222/561; 222/570

[58] Field of Search ..... 220/259, 257, 260, 307, 220/375, 269; 222/543, 569, 570

[56] References Cited

U.S. PATENT DOCUMENTS

| | | | |
|---|---|---|---|
| 3,252,635 | 5/1966 | Rosenhan | 222/570 |
| 3,307,752 | 3/1967 | Anderson | 222/569 |
| 3,590,988 | 7/1971 | Hollar | 220/306 |
| 4,349,119 | 9/1982 | Letica | 220/307 |
| 4,362,254 | 12/1982 | Roth et al. | 220/307 |

*Primary Examiner*—George T. Hall
*Attorney, Agent, or Firm*—Charles E. Brown

[57] ABSTRACT

An assembly of a nondetachable closure and a metal neck of a container in which the neck closure is contoured with sealingly interfitting parts and the closure also provides a protective guard for the thin, distortable neck.

16 Claims, 4 Drawing Figures

LIFT

NONDETACHABLE RESEALABLE CLOSURE

BACKGROUND OF THE INVENTION

This invention relates to closures of the reclosable type which are made of plastic and inserted into an appropriate opening in a metal can. Various such closures are available for non-pressurized products. The pressure-resistant types invariably are designed to tear apart and are not reclosable and those which are reclosable pose certain problems as hereinafter discussed.

SUMMARY OF THE INVENTION

The invention is directed to a novel flexible or distortable plastic closure which is easy to fabricate and provides a seal-tight fit with a uniquely formed neck of a metal container so as to eliminate leakage particularly upon repeated opening and closing of the closure.

The invention comprehends a metal container which has an integral narrow neck which is contoured to provide an internal shoulder for interlocking engagement with an underposed shoulder of a hollow plastic closure plug tightly fitted into the interior of the metal neck, the plug having additional sealing means which upon distension, due to the internal pressure generated within the container, causes the additional sealing means to sealingly engage the interior of the metal neck, the closure and neck also having on the external side of the neck further means which interlocks with a surrounding sleeve portion of the closure in a manner to resist pressure loads imposed on the closure axially of the container.

The invention also provides a closure in which the plug is pried open by a lever connected to the closure, the lever being adapted to be fulcrumed against a sleeve portion of the closure which is telescoped over the exterior side of a neck of the container to retain the closure against axial separation with respect to the neck.

One object of the invention is to provide a novel plastic closure and metal neck assembly of a metal container which is made of soft aluminum wherein the plastic closure incorporates a sleeve which completely encloses the neck and projects a substantial distance above the end of the metal neck to shield the neck from accidental blows such as could distort or bend the metal thereby developing leaks.

These and other objects of the invention inherent in and encompassed by the invention will become more apparent from the specification and the drawings, wherein.

DESCRIPTION OF THE INVENTION

Figures 1, 2, 3, 4:
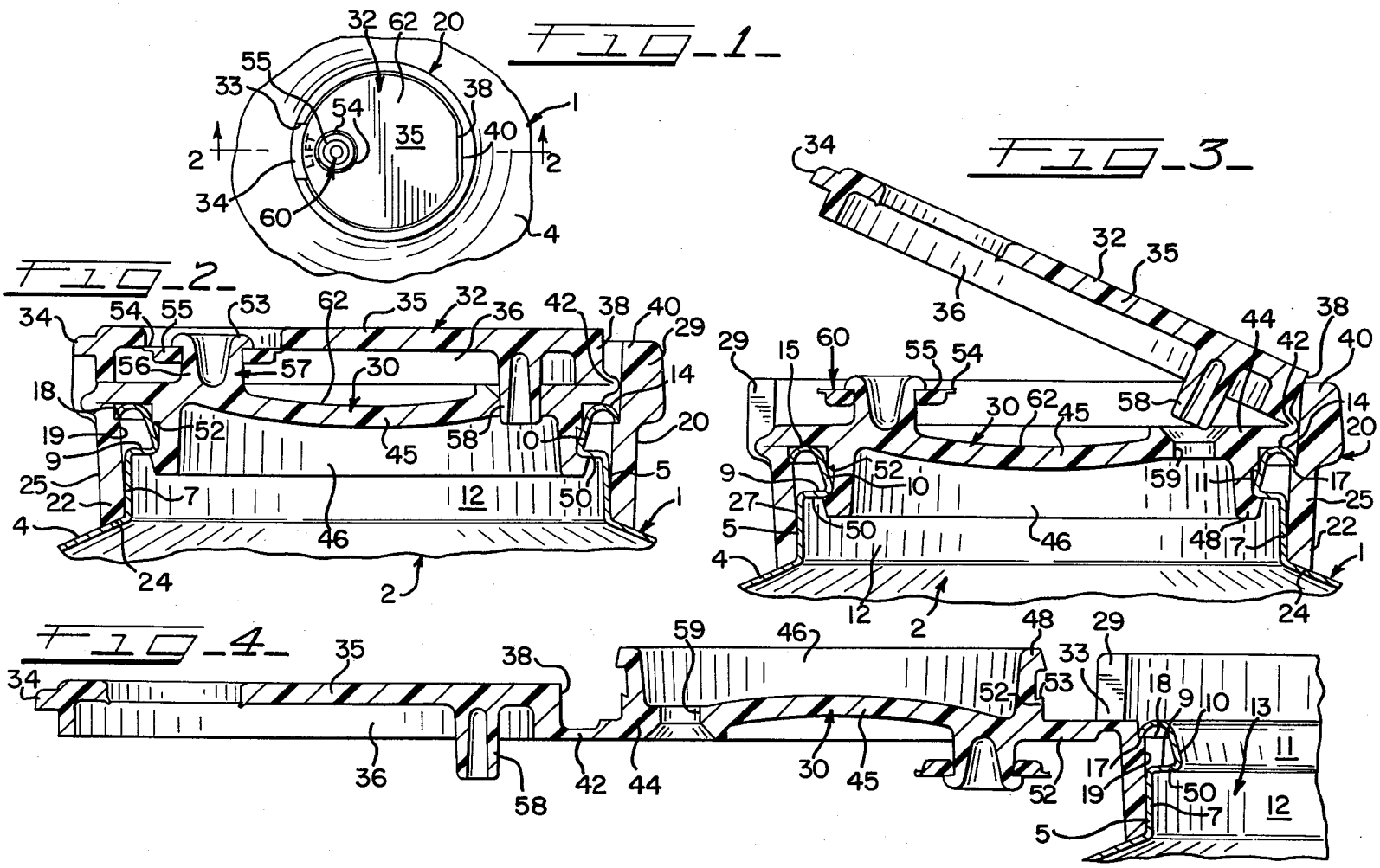
FIG. 1 is a fragmentary top plan view of the novel closure and container.
FIG. 2 is an enlarged cross-sectional view taken substantially on line 2—2 of FIG. 1 showing the parts in closed position.
FIG. 3 is a view similar to FIG. 2 showing the lever in lifted position with the pilferproof indicia broken.
FIG. 4 is a section similar to FIG. 2 showing the parts in a fully open position; a portion of the neck structure being broken away.

The drawings fragmentarily show the upper end portion 1 of the metal (preferably aluminum) can 2 which has a body and bottom (not shown) as well known in the art. The end portion 1 comprises a dome 4 with a narrow integral axially extending neck 5.

The neck 5 comprises a lower generally cylindrical, preferably slightly upwardly tapered section 7 which extends upwardly from the dome 4 and merges intermediate the ends of the neck with the outer periphery of an inturned flange or shoulder 9, the inner edge of flange 9 merging into the lower end of an upwardly flaring frusto-conical upper neck section 10 having an internal frusto-conical surface 11 which with the interior surface 12 of the lower cylindrical section defines a bore or pour opening 13 for filling and discharging liquid from the container.

The upper end of the section 10 is formed with an outwardly extending annular bead or hook 14 which is convexed upwardly providing an upwardly facing seating surface 15. The hook projects at its outer edge beyond the outer periphery or circumference of the lower generally cylindrical section of the neck and terminates in a downturned edge or margin 17 and hooks over a stepped-in shoulder 18 on the interior surface 19 or a plastic guard sleeve portion 20 of the closure intermediate its ends.

The sleeve portion has a lower end 22 seated complimentally against the tapered top side 24 of the dome section and has a lower portion 25 snugly wrapped about the external surface 27 of the lower section 7. An upper thickened guard portion 29 of the sleeve 20 projects above the plug 30 and encloses an operating lever assembly 32 of the closure.

The guard portion 29 is in the form of a ring with a section cut out at 33 for accommodating a lift tab portion 34 of a lever assembly 32. The remainder of the lever assembly fits within the confines of the ring and is formed as an annular disk having a top wall 35 and a peripheral dependent flange 36. At its side diametrically opposite to the lift tab, the lever is flattened to provide a chordally disposed lever fulcrum edge 38 which opposes a similarly formed chordally extending fulcrum 40 integrated with guard ring 29 and spaced slightly radially outwardly from edge 38. The lever is connected in the area of the fulcrum edge 38 by a strap 42 to the adjacent portion of the top wall 44 of the plug 30.

The top wall 44 of plug 30 has an inwardly disked pressure resistant central portion 45 from which depends a cylindrical hollow closure sleeve 46 which fits into the bore 13. The sleeve 46 has an outwardly projecting annular shoulder 48 at its lower edge which catches under a downwardly facing surface 50 of shoulder 9. The closure sleeve 46 also has an annular sealing ring 52 with an apical edge 53 in tight engagement with surface 11. Inasmuch as the closure sleeve 46 is made of plastic such as polyethylene or polypropylene or like resin, the pressure of the gasses in the beverage contained in the can causes the plug to be subjected to axial load against its top wall, thus tightly urging the top edge of ring 52 against face 50. At the same time the pressure in the container expands the closure or plug sleeve 46 radially and tightly engages the sealing ring against the surface 11.

The plug 30 is connected by a strap 52 to the external guard sleeve 20.

In the initial closed position of the closure, the lever is laid over the top wall of the plug and the frangible straps 54 of its anti-pilfer disk 55 are unbroken. The disk 55 is connected by a rivet-like structure 57 formed on and projecting from the top wall 44 of the plug 30. The disk is slidable between the top wall 44 of the plug and the head 53. The lever also has a depending vent stem 58 extending into a vent opening 59 in wall 44 of the plug.

In operation, the lever is lifted by the tab 34 and the tamper indicator generally designated 60 is broken apart and the stem 58 is withdrawn from the vent opening 55. The lever is swung in a clockwise direction about the fulcrum 40 and pulls the tether 42, thus deforming the adjacent portion of the plug and pushing it out of the bore 13. The plug, being connected by the tether 52, is retained with the lever on the container. To reclose, the plug sleeve portion 46 is forced into the bore 13 by applying digital pressure against the top side 62 of the top wall 44 of the plug until the shoulder 48 snaps under the surface 50. Then the lever is laid over the top wall by entering the vent post into the vent opening.

A preferred embodiment of the invention has been disclosed, modifications of which will readily become apparent within the scope of the appended claims.

What is claimed is:

1. A combination flexible plastic closure and a container neck assembly in which said neck is of tubular form having intermediate its ends an inwardly directed flange terminating in an apical edge and having from said edge an axially outwardly flaring section with a frusto-conical internal surface defining a pour opening, said closure comprising a plug removably positioned in said pour opening and including a tubular flexible wall having an annular sealing ring projecting in closed position under said flange in fluid-tight engagement therewith and an external sealing ring on said tubular wall having an apical edge in fluid-tight engagement with said frusto-conical surface, combination guard and fulcrum means encompassing said neck assembly and in the closed position of said plug extending axially above the plug, and means for withdrawing the plug from said pour opening by fulcruming upon said combination means and tugging on said plug to release the same from said opening.

2. The invention according to claim 1 and wherein said combination guard and fulcrum means encompass said neck portion and said container has a transverse wall portion at the base of neck and said combination means has a reactive seating engagement against said transverse wall portion.

3. The invention according to claim 1 and wherein said combination means comprises a ring of plastic material sleeved over said neck and having a hook-like engagement therewith to prevent axial separation.

4. The invention according to claim 1 and said means for withdrawing the ring comprising a lever having pilfer-indicating means thereon, said lever being flexible toward the container and said pilfer-indicating means comprising a wafer with frangible means and means connecting the wafer to said plug and comprising a post having a sliding fit with said wafer permitting flexing of said lever toward said container whereby said frangible means remain unbroken.

5. In an assembly of a plastic closure and a neck of a container, said neck having a radially outwardly projecting hook-like upper end portion defining a pour opening of a container; and said plastic closure having a closure portion insertable in fluid-tight fit into said container pour opening, and a separate but integral retainer portion sleeved over said neck and hooked under said hook-like portion, there being a hinge connection between said closure portion and said retainer portion for separate displacement of said closure portion relative to said neck.

6. The invention according to claim 5 and wherein the contour of said neck portion includes a radially inwardly offset section of the neck forming said sealing means.

7. A closure for a container having a wall with a neck member providing a pour opening;

said closure comprising a flexible plastic plug having a seal-tight fit within said pour opening, a plastic guard member encompassing said neck member, a lift lever connected to said plug, and one of said members being formed to provide a combination pouring lip and fulcrum for fulcruming engagement by said lever upon lifting and tilting of said lever to thereby uncover said pour opening by lifting said plug out of said pour opening.

8. The invention according to claim 7 wherein said pouring lip and fulcrum are formed on said plastic guard member.

9. The invention according to claim 8 with said guard member being seated at one end against said neck member.

10. The invention according to claim 7 wherein said neck member has a sharp corner directed toward said plug and said plug has an apical portion directed toward said neck member.

11. In a container, a neck, said neck being of a tubular form and having intermediate ends thereof a radially inwardly directed flange terminating in an apical edge, and a radially and axially flaring section extending from said apical edge, said section having a frustoconical inner surface defining a pour opening.

12. A container neck according to claim 11 wherein said section terminates in an outwardly turned curl having an axially facing free annular locking edge.

13. A container neck according to claim 12 wherein said neck axially inwardly of said flange is cylindrical and of an external diameter approaching that of but less than the diameter of said locking edge.

14. A container neck according to claim 13 wherein said neck terminates in a container shoulder which generally opposes said locking edge.

15. A container neck according to claim 12 wherein said neck terminates in a container shoulder which generally opposes said locking edge.

16. A container neck according to claim 11 wherein said neck is formed of metal.

* * * * *